US005711041A

United States Patent [19]

Chen

[11] Patent Number: 5,711,041

[45] Date of Patent: Jan. 27, 1998

[54] INFLATABLE AIR MATTRESS WITH INTERNAL PUMP

[75] Inventor: John Chen, Sharon, Mass.

[73] Assignee: CSA, Inc., South Easton, Mass.

[21] Appl. No.: 622,755

[22] Filed: Mar. 27, 1996

[51] Int. Cl.[6] ..... A47C 27/08

[52] U.S. Cl. ..... 5/708; 5/712

[58] Field of Search ..... 5/706, 708, 711, 5/712

[56] References Cited

U.S. PATENT DOCUMENTS

| | | | |
|---|---|---|---|
| 3,042,941 | 7/1962 | Marcus | 5/708 |
| 3,069,494 | 12/1962 | Pinkwater | 5/708 |
| 3,133,696 | 5/1964 | Mirando | 5/708 X |
| 3,155,991 | 11/1964 | Dunham | 5/708 |
| 3,780,388 | 12/1973 | Thomas et al. | 5/711 |
| 4,930,174 | 6/1990 | Hunter | 5/708 |
| 5,437,068 | 8/1995 | Fisher | 5/712 |

*Primary Examiner*—Michael F. Trettel
*Attorney, Agent, or Firm*—Herbert L. Bello

[57] ABSTRACT

Disclosed is an air mattress apparatus. The apparatus includes a pump contained within an inflatable chamber. The pump is in fluid communication with the inflatable chamber via intake and exhaust ports. One-way valves positioned on the intake and exhaust ports of the pump control the flow of air from the pump to the inflatable chamber of the air mattress. The pump contains a resilient, closed-cell foam pump material. The mattress is inflated by repeatedly compressing the pump material and then permitting it to expand and fill with air.

20 Claims, 3 Drawing Sheets

INFLATABLE AIR MATTRESS WITH INTERNAL PUMP

BACKGROUND OF THE INVENTION

1. Field of the Invention

The present invention relates to air mattresses. More particularly, the present invention is directed to an air mattress having self-contained, internally mounted pump system.

2. Description of the Prior Art

Air mattresses are increasingly used in a wide variety of applications. For example, in their various configurations air mattress are currently used in fields of endeavor as diverse as recreation and health care. Fostering this expanded use are, among other things, the durability, low manufacturing cost, and easy use of air mattresses.

To meet the needs of an expanding market, air mattresses of various configurations have been designed and developed. The most common air mattresses include a sealed enclosure having a single aperture used for inflation and deflation. Modifications to this basic design include, for example, texturing of exposed surfaces, and segmentation or compartmentalization of the air containing envelope. Further, a diversity of polygonal designs and cross-sectional configurations have been developed in order to provide air mattresses having configurations useful for specific applications, including, for example, back braces and cushioning assemblies.

Although air mattresses have met with favorable economic success, those currently available in the marketplace suffer from a significant operational limitation. In particular, none of the air mattresses currently available incorporate a pump system as an integral component. Accordingly, users must purchase separate pumping apparatuses in order to use available mattresses. This requirement increases the overall cost of the air mattress and, thus, limits marketability. In addition, owners must always carry the pump in order to inflate the air mattress.

A need has arisen for an air mattress apparatus which does not suffer from the foregoing disadvantages and limitations.

SUMMARY OF THE INVENTION

It is an object of the present invention to provide an improved air mattress apparatus.

Another object of the invention is to provide an air mattress apparatus that can be easily and efficiently inflated.

A further object of the invention is to provide an air mattress apparatus which includes a self-contained pumping system.

A still further object of the present invention is to provide an air mattress apparatus of improved structural integrity for greater comfort and durability.

It is still another object of the present invention to provide an air mattress apparatus having a plurality of internal ribs that are disposed in complementary undulating patterns.

The air mattress of the invention generally comprises an inflatable chamber and an internally mounted pump. Typically, the pump is contained within the inflatable chamber. Incorporation of the pump in the inflatable chamber forms a self-contained apparatus that is easily inflated prior to use.

The inflatable chamber typically is formed from a set of walls, for example, a top wall, a bottom wall, and a series of sidewalls. The walls of the inflatable chamber are joined together, by welding, for example, such that their inner surfaces form a sealable interior chamber. During use, the outer surfaces of the walls are exposed to ambient environmental conditions. A plurality of undulating ribs can be secured in position, by welding, for example, within the inflatable chamber in order to augment the structural integrity of the air mattress during use. The walls of the inflatable chamber and ribs are typically formed from a substantially non-porous, flexible material.

As noted above, disposed within the inflatable chamber of the air mattress is the pump. The pump generally includes a pump housing defined by a set of walls composed of a flexible material. Typically, the depth of the pump housing is substantially equivalent to or sightly less than the height of the sidewalls of the inflatable chamber. If desired, a portion of the walls forming the inflatable chamber and the walls forming the pump housing can be a common wall. The walls of the pump housing cooperate to form a pump chamber. Like the walls of the inflatable chamber, the walls of the pump are formed from a substantially non-porous, flexible material.

A resilient, compressible pumping material is contained within the pump chamber, the depth of the pumping material is substantially equivalent to the height of the pump chamber. In one embodiment, the pumping material is a high density, closed cell foam that can be easily compressed by the application of a force. Once the force is removed, the foam returns to its original size and shape.

The pump housing includes an intake port and an exhaust port through which air flows from the outside of the air mattress to the inflatable interior chamber. More particularly, the intake port provides a fluid communication between the outside of the air mattress and the pump chamber. The exhaust port provides a fluid communication between the pump chamber and the inflatable chamber. Structurally, the intake port defines a channel between the outside of the air mattress and the pump chamber while the exhaust port defines a one-way flow channel between the pump chamber and the inflatable chamber.

The flow of air through the exhaust port is typically controlled by a one-way valve. The flow of air through the intake port is controlled by a through port or valve and a stopper or one-way valve. In operation, the valve on the intake port regulates the flow of air between the outside of the inflatable chamber and the pump chamber. The one-way valve on the exhaust port permits air to flow from the pump housing into the inflatable chamber and prevents air from flowing from the inflatable chamber into the pump chamber. When the intake and exhaust valves are opened air can move through their respective ports; and when the valves are closed, the flow of air is blocked through these ports.

To commence inflation of the air mattress of the invention, the intake port is opened and the pumping material is in its expanded state and full of air. Next, the intake port is closed and a force is applied to the pump housing to compress the pumping material. Compression of the pumping material forces the air in the pumping material to flow through the exhaust port into the inflatable chamber. Next, the force is removed from the pumping material and the intake port is opened. The pumping material expands and draws in air as it expands. Concurrent with this expanding action, the valve on the exhaust port closes so as to foreclose the backflow of air into the pump chamber from the inflatable chamber of the mattress. The pumping material continues to draw in outside air until it returns to its fully expanded state. The pump housing is continuously cycled through the above-stated compression and inflation steps until the inflatable chamber is fully expanded. Upon achievement of this result, the intake port can, if desired, be sealed with a removable stopper, plug or cap.

After the air mattress has been used as desired, it can be deflated and stored for later use. Deflation of the air mattress can be achieved by opening of a release valve that communicates with the inflatable chamber and the outside air.

Other general and specific objects of the invention will in part be obvious and will in part appear hereinafter.

The invention accordingly comprises the method and apparatus embodying steps, features of construction, combinations of elements, and arrangements of parts adapted to effect such steps, as exemplified in the following detailed disclosure, the scope of the invention is indicated in the claims.

BRIEF DESCRIPTION OF THE DRAWINGS

For a fuller understanding of the nature and objects of the invention, reference should be made to the following detailed description and the accompanying drawings, in which.

DESCRIPTION OF PREFERRED EMBODIMENTS

Figure 1:
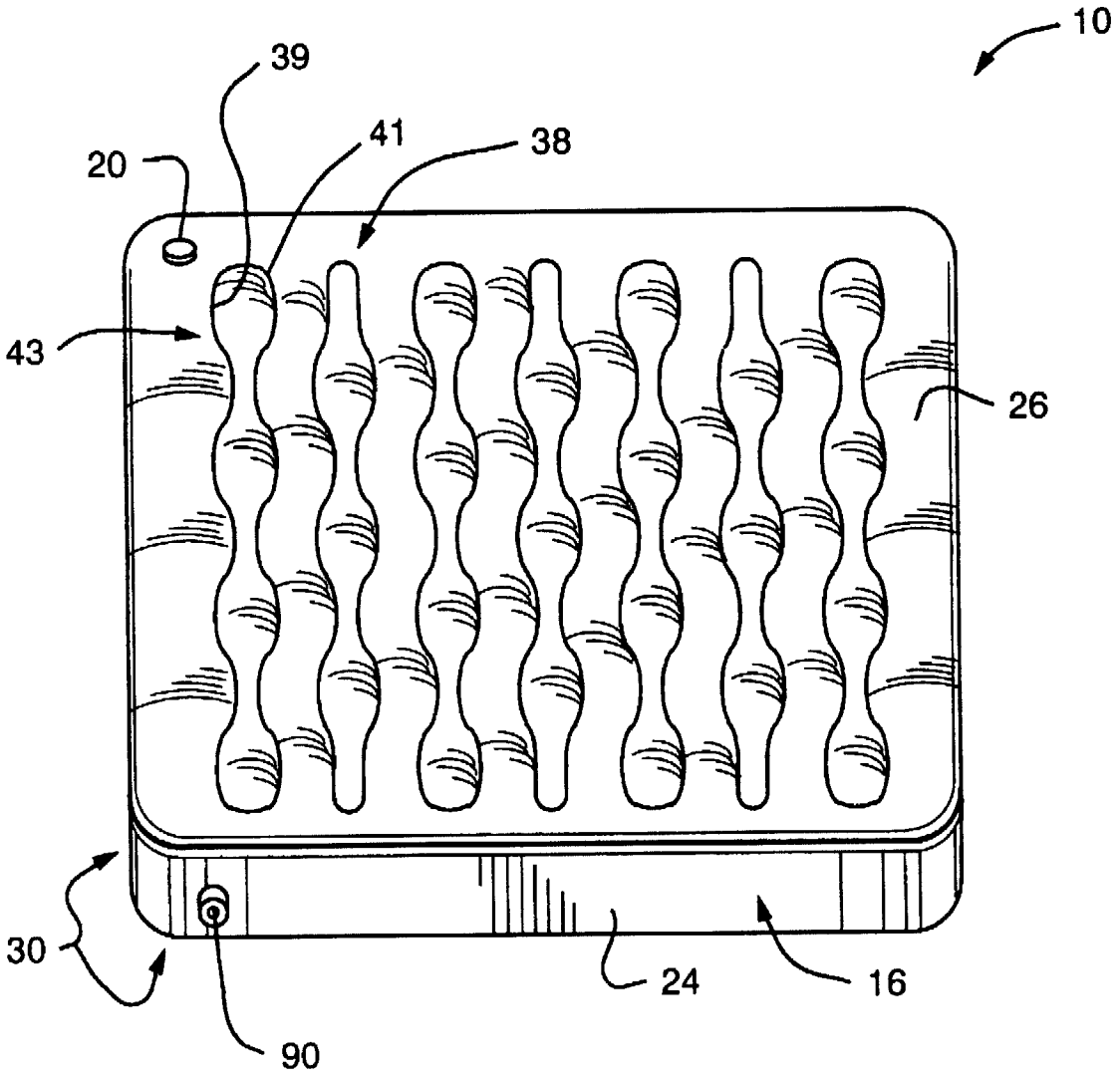
FIG. 1 is a perspective view of the air mattress of the invention.

Referring to the drawings, particularly FIG. 1, there is illustrated an air mattress 10 embodying the present invention. The air mattress 10 generally includes an inflatable chamber 12 and a pump 14. Although a rectangular configuration is depicted in the several FIGURES, those skilled-in-the-art will appreciate that the air mattress 10 can be sized and shaped as desired. Further, the configuration of the inflatable chamber 12 can be selected as desired for a given application. The cross-sectional configuration of the inflatable chamber 12 can also be altered as desired in order to provide the desired level of support for a given usage.

Figure 2:
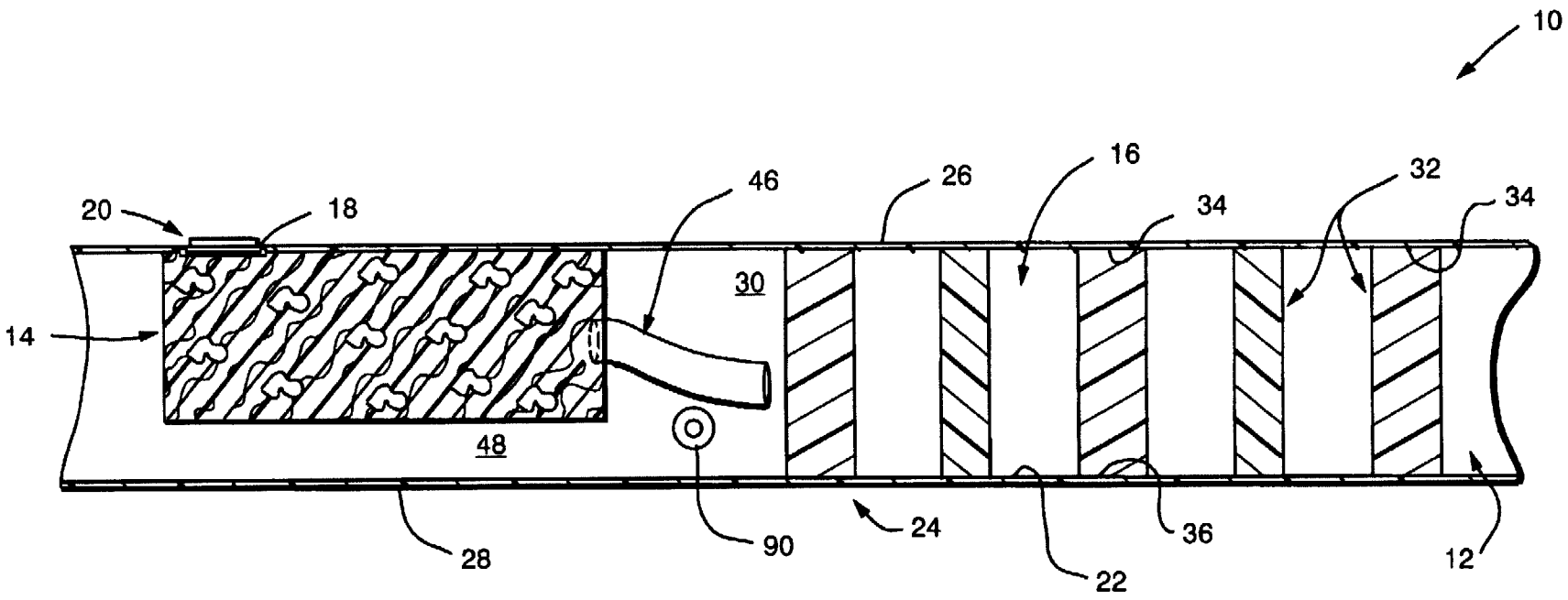
FIG. 2 is a side, cut-away view of the air mattress of the invention.

Referring to FIGS. 1 and 2, the inflatable chamber 12 is an interior cavity contained within the air mattress 10. A series of sidewalls 16 form the inflatable chamber 12. At least one of the sidewalls 16 includes an aperture 18 configured to receive a portion of the intake port 20 of the pump 14.

Each of the sidewalls 16 have an inner surface 22 and an outer surface 24. In the preferred embodiment of the invention as depicted in the FIGS. 1 and 2, the sidewalls 16 include a top wall 26, a bottom wall 28, and a series of sidewalls 30. All of the walls 26, 28, and 30 are joined together by electrostatic welding, for example, in order to form the sealable enclosure of the inflatable chamber 12. More particularly, the walls 26, 28, and 30 are welded together such that their inner surfaces 22 form the inflatable chamber 12. Once joined, the outer surfaces 24 of the sidewalls 16 are exposed to ambient environmental conditions. The sidewalls 16 of the inflatable chamber 12 are formed of a substantially non-porous, flexible material. In the preferred embodiment of the invention as depicted in the several FIGURES, the flexible material used to form the sidewalls 16 is a dimensionally stable polymer, for example, a plastic such as PVC. Those skilled-in-the-art will appreciate, however, that virtually any material can be used to form the sidewalls 16 providing its permeability characteristics are sufficient to contain a gas, for example, air.

If desired, a plurality of ribs 32 can be secured in position within the inflatable chamber 12. In operation, the ribs 32 augment the structural integrity of the air mattress 10. The ribs 32 are disposed substantially perpendicular to top wall 26 and bottom wall 28. Typically, the ribs 32 are secured in place by electrostatical welding their upper edge 34 and lower edge 36 to the inner surfaces 22 of the top wall 26 and bottom wall 28, respectively. In a preferred embodiment of the invention, the ribs 32 are welded in place so as to form an undulating pattern 38 on the top wall 26 and bottom wall 28 of the air mattress 10. To achieve this result, complementary undulating forms are used to lay-out the rib pattern 38 during production of the air mattress 10. Preferably, a flexible material, for example, a dimensionally stable polymer such as plastic or PVC, is used to form the ribs 32. Of course, virtually any material can be used to form the ribs 32 providing it has the desired level of structural integrity once the air mattress 10 is inflated.

In the preferred embodiment of the invention, the rib pattern 38 consists of a first sine-wave-like pattern 39 and a second sine-wave-like pattern 41. The patterns 39 and 41 are paired together to form a sub-pattern 43. More particularly, sub-pattern 43 is produced by pairing patterns 39 and 41 together such that they are 180 degrees out of phase. As many repetitions of sub-pattern 43 as necessary are utilized in order to provide the requisite mechanical strength to the air mattress 10. Preferably, succeeding sub-patterns 43 are positioned such that each sub-pattern 43 is 180 degrees out of phase vis-a-vis each preceding sub-pattern 43.

Figure 3:
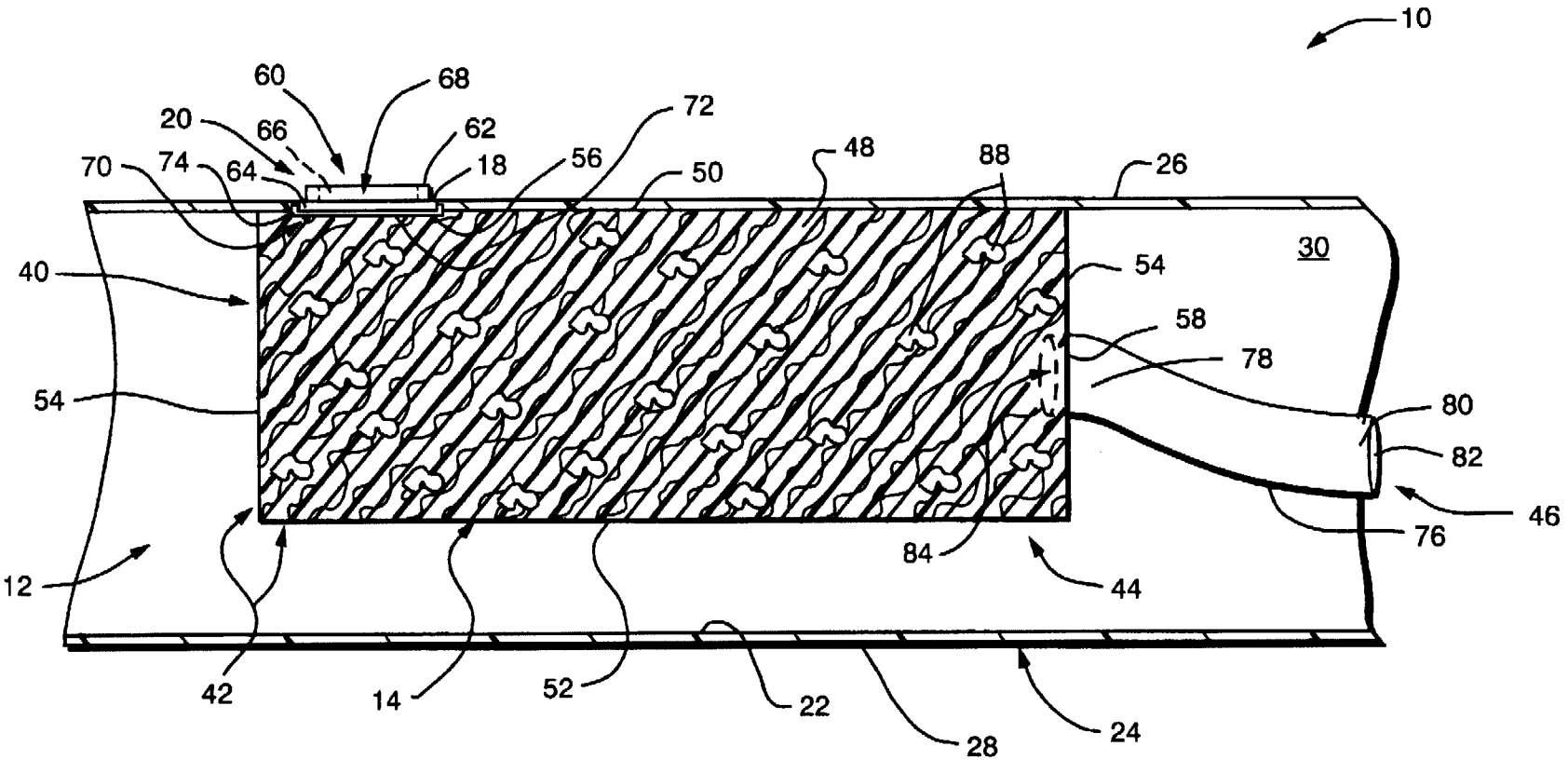
FIG. 3 is a side, cut-away view, providing a close-up view, of the pump system incorporated in the air mattress of the present invention.

As shown in FIGS. 2 and 3, disposed within the inflatable chamber 12 of the air mattress 10 is the pump 14. The pump 14 generally includes a pump housing 40 defined by a series of walls 42. The pump housing 40 contains a pump chamber 44. If desired, a portion of those sidewalls 16 forming the inflatable chamber 12 and the walls 42 forming the pump housing 40 can be configured as a common wall. Extending from the walls 42 are an intake port 20 and an exhaust port 46. Contained within the pump chamber 44 is a pump material 48. Typically, the walls 42 are sized and shaped such that the depth of the pump housing 40 is substantially equivalent to the depth of the sidewalls 16 of the air mattress 10 when the air mattress 10 is fully inflated.

As noted above, walls 42 cooperate to form a pump housing 40. In the preferred embodiment of the invention as depicted in the several FIGURES, the walls 42 include a top wall 50, a bottom wall 52, and a set of sidewalls 54. All of the walls 50, 52, and 54 are joined together, that is, welded, in order to form the desired sealable enclosure, i.e., the pump chamber 44. The top wall 50, bottom wall 52, or sidewalls 54 typically include an aperture 56. As described in detail below, the aperture 56 provides an egress for the intake port 20 of the pump 14. One of the sidewalls 54 typically also includes an aperture 58 which provides access for an exhaust port 46 of the pump 14. As discussed in greater detail below, the ports 20 and 46 provide channels which guide the flow of air between the outside of the air mattress 10 and the inflatable chamber 12. Like the sidewalls 16 of the inflatable chamber 12, the walls 50, 52, and 54 of the pump 14 are formed from a substantially non-porous, flexible material, for example, PVC or plastic.

In the preferred embodiment of the invention as shown in FIGS. 2 and 3, the intake port 20 is an annular, axially extending, tubular member 60 having a first end 62 and a second end 64. An interior bore 66 of the member 60 defines a channel 68 through which air can pass. The first end 62 of the tubular member 60 of the intake port 20 is connected to the aperture 18 in a sidewall 16 of the inflatable chamber 12. The second end 64 of the tubular member 60 of the intake port 20 connects to the aperture 56 of the pump housing 40. In operation, via the channel 68 created by bore 66, intake port 20 provides a fluid communication for the flow of air from the environment outside of the air mattress 10 to the pump chamber 44.

In one embodiment of the invention, the intake port 20 remains open at all times. In an alternative embodiment of the invention as shown in FIGS. 2 and 3, the flow of air through the intake port 20 can be regulated by a one-way valve 70. When used, the valve 70 typically is a flange 72 anchored along one edge 74 to the appropriate wall 42 of the pump housing 40. The valve 70 has an open and a closed position. In operation, the valve 70 on the intake port 20 permits air to flow from the environment outside of the air mattress 10 into the pump chamber 44. When the valve 70 is opened, air can move through the bore 66 and into the pump chamber 44. When the valve 70 is closed, communication between the outside of the air mattress 10 and the pump chamber 44 is blocked. The valve 70 typically is manufactured from a material similar to that used to form the sidewalls 16 of the inflatable chamber 12, i.e., a substantially non-porous, flexible material such as PVC or plastic.

The exhaust port 46 also has an annular configuration. More particularly, the exhaust port 46 is an axially extending member 76 having a first end 78 and a second end 80. An interior bore 82 of the member 76 defines a channel 84 through which air can pass. The first end 78 of the member 76 of the exhaust port 46 connects to the aperture 58 in one of the sidewalls 54. The second end 80 of the member 76 of the exhaust port 46 extends into the inflatable chamber 12. In operation, via bore 82, exhaust port 46 provides a fluid communication for the flow of air from the pump chamber 44 to the inflatable chamber 12.

In the preferred embodiment of the invention as depicted in FIGS. 2 and 3, the flow of air through the exhaust port 46 is regulated using the tubular member 76 as a one-way valve. More particularly, when air is forced into the exhaust port 46 air pressure causes the bore 82 of the member 76 to expand. This expansion permits the passage of air from the pump chamber 44 into the inflatable chamber 12 to occur. When the flow of air ceases, the member 76 collapses under its own weight, closing the bore 82, and preventing the further passage of air from the inflatable chamber 12 into the pump chamber 44. This action also forecloses deflation of the inflatable chamber 12. In order for the member 76 to function in this manner, those skilled-in-the-art will appreciate that it must be manufactured from a strong, but pliable, material. In the preferred embodiment of the invention, the member 76 typically is manufactured from a material similar to that used to form the sidewalls 16 of the inflatable chamber 12, i.e., a substantially non-porous, flexible material such as PVC or plastic.

In an alternative embodiment of the invention (not shown), the flow of air through the exhaust port 46 can be regulated by a one-way flapper valve. When used, the one-way flapper valve typically is a flange anchored along one edge to a sidewall 42 of the pump housing 40. This valve has an open and a closed position. When the valve is opened air can move through the bore 82 of the member 76 and into the inflatable chamber 12. When the valve is closed, communication between the pump chamber 44 and inflatable chamber 12 is blocked. That is, when air attempts to flow from the inflatable chamber 12, the flapper valve closes and prevents air from flowing out of the inflatable chamber. The valve typically is manufactured from a material similar to that used to form the sidewalls 16 of the inflatable chamber 12, i.e., a substantially non-porous, flexible material such as PVC or plastic.

Contained within the pump chamber 44 is a porous, resilient pumping material 48. The pumping material 48 preferably is sized and shaped such that it occupies substantially all of the space within the pump chamber 44. Accordingly, the height of the pumping material 48 is substantially equivalent to the height of the sidewalls 16 of the air mattress 10. Operationally, the resiliency of the pump material 48 imparts a similar resiliency to the pump 14. That is, the pump material 48 forces the pump 14 to operate as a self-actuating bellows. This feature permits the cycling of compression and inflation necessary for the pump 14 to function as an inflationary device.

Typically, the pumping material 48 is a high density, closed-cell foam. More particularly, the pumping material 48 has a cross-sectional configuration displaying a fine collection of pockets 88. Operationally, when the pumping material 48 is compressed, and then permitted to expand, air is captured in the pockets 88. Later compression of the pumping material 48, and thus its pockets 88, forces the air contained in the pockets 88 to be released and channeled as directed by the valves 70 and 76 of the intake port 20 and exhaust port 46, respectively.

In the preferred embodiment of the invention, to commence inflation of the air mattress of the invention 10, the intake port 20 is opened and the pumping material 48 is permitted to expand until it is full of air. A force is then applied to the pump housing 40. Generally, the force is applied by stepping on the pump housing 40. Application of this force compresses both the pump housing 40 and the pumping material 48 contained therein. As the pumping material 48 is compressed, air trapped in the pumping material 48 is forced through the exhaust port 46 into the inflatable chamber 12. After the pumping material 48 is fully compressed, the force is removed from the pump housing 40 and intake port 20 is opened. This action permits the pumping material 48 to return to its original size. Concurrent with this action, the valving action of the member 76 of the exhaust port 46 closes the bore 82 so as to foreclose the backflow of air from the inflatable chamber 12 of the mattress of the invention 10. Air is then permitted to flow into the pump housing 40 and hence pump material 48 through the intake port 20 until the pump chamber 44 and pumping material 48 are fully expanded.

Once the pump housing 40 and pumping material 48 are fully expanded, the pump housing 40 is again compressed, i.e., stepped on. This compression action causes the valve 70 positioned on the intake port 20 to close and the bore 82 of the member 76 to expand, i.e., open. Further, as a result of the compression of the pumping material 48, that air contained in the pockets 88 of the pumping material 48 is forced out of the pumping material 48 and into the inflatable chamber 12 of the air mattress 10. This airflow is again directed by, respectively, the closure of the intake port valve 70 and opening of the bore 82 of the member 76. When full compression is achieved, the bore 82 of member 76 once again closes so as to foreclose any deflation of the air mattress of the invention 10.

The pump housing 40 is continuously cycled through the above-stated compression and inflation steps until the inflatable chamber 12 is fully inflated. Upon achievement of this result, the intake port 20 can, if desired, be sealed so as to avoid deflation of the air mattress 10.

After the air mattress 10 has been used as desired, it can be deflated and stored for later use. Deflation of the air mattress 10 can be achieved by concurrently opening of the intake port 20 and exhaust port 46. Alternatively, opening of an independent release valve 90 will release the air contained in the interior inflatable chamber 12.

It will thus be seen that the invention efficiently attains the objects set forth above, among those made apparent from the preceding description.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An inflatable apparatus comprising:

(a) at least one inflatable chamber defined by a first set of wall means, said first set of wall means formed from a substantially non-porous, flexible material, said first set of wall means having an inner surface and an outer surface, an inflatable chamber being formed by said inner surface, said outer surface exposed to an ambient environment;

(b) a plurality of internally disposed ribs, a portion of each said ribs attached to said inner surface of said first set of walls means, said ribs being disposed in rows in a sine-wave-like pattern, at least a portion of said ribs being disposed 180 degrees out of phase with one another;

(c) a pump means disposed within said inflatable chamber, said pump means including a pump housing defined by a second set of wall means, said second set of wall means formed from a substantially non-porous, flexible material, a portion of said first set of wall means and said second set of wall means being common walls, an interior pump chamber formed by said pump housing;

(d) compressible pumping material, said pumping material being disposed within said pump chamber of said pump means;

(e) an intake port means providing fluid communication between said outer surface of said first set of wall means and said pump chamber, said intake port means defining a channel between said outer surface of said first set of wall means and said pump chamber; and, (f) a one-way exhaust port means providing fluid communication from said pump chamber to said inflatable chamber.

2. The apparatus of claim 1 wherein a portion of said first set of wall means and said second set of wall means are common walls.

3. The apparatus of claim 1 wherein said porous, resilient and compressible material is a high-density closed-cell foam.

4. The apparatus of claim 1 wherein said intake port means includes a one-way valve means, said valve means having a first open position and a second closed position.

5. The apparatus of claim 4 wherein said valve means is configured such that when said valve means is in said first open position said intake port means provides a fluid communication between the outside of said inflatable housing and said pump chamber and when said valve means is in said second closed position communication is blocked between the outside of said inflatable housing and said pump chamber.

6. The apparatus of claim 1 wherein said exhaust port means includes a one-way valve means, said one-way valve means having a first open position and a second closed position.

7. The apparatus of claim 6 wherein said one-way valve means is configured such that when said one-way valve means is in said first open position said exhaust port means provides a fluid communication from said pump chamber to said inflatable chamber and when said valve means is in said second closed position communication is blocked between said pump chamber and said inflatable chamber.

8. An inflatable air mattress apparatus, said apparatus comprising:

(a) an inflatable chamber defined by a top wall means, sidewall means, and a bottom wall means, all of said wall means being formed from a substantially non-porous, flexible material, all of said wall means having an inner surface and an outer surface, said inner surfaces of said wall means defining said inflatable chamber, said inflatable chamber containing a plurality of support rib means, said outer surface being exposed to ambient environmental conditions;

(b) a plurality of internally disposed ribs, each of said ribs attached to said inner surface of said top wall and said inner surface of said bottom wall, said ribs disposed in rows, said ribs being disposed in a sine-wave-like pattern, at least a portion of said rows of said ribs being disposed 180 degrees out of phase with one another;

(c) a pump means disposed within said inflatable chamber, said pump means including a pump housing defined by housing wall means, said housing wall means formed from a substantially non-porous, flexible material, an interior pump chamber formed by said pump housing;

(d) a porous, resilient and compressible pumping material, said pumping material being disposed within said pump chamber of said pump means;

(e) an intake port means providing fluid communication between said outer surface of said first set of wall means and said pump chamber, said intake port means defining a channel between said outer surface of said wall means and said pump chamber; and, (f) a one-way exhaust port means providing fluid communication between said pump chamber to said inflatable chamber.

9. The apparatus of claim 8 wherein a portion of one of said top wall means, bottom wall means, or sidewall means and said pump housing wall means are common walls.

10. The apparatus of claim 8 wherein said porous, resilient and compressible material is a high density, closed-cell foam.

11. The apparatus of claim 8 wherein said intake port means includes a one-way valve means, said valve means having a first open position and a second closed position.

12. The apparatus of claim 11 wherein said valve means is configured such that when said valve means is in said first open position said intake port means provides a fluid communication between said outside of said inflatable chamber and said pump chamber and when said valve means is in said second closed position communication is blocked between said outside of said inflatable chamber and said pump housing.

13. The apparatus of claim 8 wherein said exhaust port means includes a one-way valve means, said one-way valve means having a first open position and a second closed position.

14. The apparatus of claim 13 wherein said valve means is configured such that said valve means is movable between said first open position and said second closed position, when said valve means is in said first open position said exhaust port means provides a fluid communication from said pump chamber to said inflatable chamber and when said valve means is in said second closed position communication is blocked between said pump chamber and said inflatable chamber.

15. In combination with an inflatable mattress apparatus having an inflatable chamber, wherein the improvement comprises:

(a) a pump means disposed within said inflatable chamber of said mattress, said pump means including a pump housing, said pump housing including an intake port means and a one-way exhaust port means, said pump housing being formed from a substantially non-porous, flexible material, said pump housing defining a pump chamber, said intake port means defining a channel between an outer surface of said air mattress and said pump chamber, said exhaust port means defining a channel between said pump chamber and said inflatable chamber of said mattress;

(b) an expandable and compressible porous material disposed with said pump chamber of said pump means; and (c) a plurality of ribs, each said rib disposed in a sine-wave-like pattern, said ribs positioned within said inflatable chamber of said mattress in a plurality of row pairs, each said row pair having sine-wave-like patterns that are phase shifted from one another, each said row pair displaced from adjacent row pairs by 180 degrees.

16. The apparatus of claim 15 wherein a portion of said pump housing and said air mattress have common walls.

17. The apparatus of claim 15 wherein said porous, expandable and compressible material is a closed-cell foam.

18. The apparatus of claim 15 wherein said intake port means includes a one-way valve means, said valve means having a first open position and a second closed position.

19. The apparatus of claim 15 wherein said exhaust port means includes a one-way valve means, said valve means having a first open position and a second closed position.

20. An inflatable air mattress apparatus, said apparatus comprising:

(a) an inflatable chamber defined by a first set of wall means, said first set of walls means including a top wall, a bottom wall and sidewalls, said first set of wall means formed from a substantially non-porous, flexible material, each of said top wall, said bottom wall and said sidewalls having an inner surface and an outer surface, an inflatable chamber being formed by said inner surfaces, said outer surfaces exposed to an ambient environment; and (b) a plurality of internally disposed ribs, said ribs attached to an inner surface of said top wall and said inner surface of said bottom wall, said ribs disposed in alternating rows of first and second patterns, said first pattern having a pair of sine-wave-like pattern that are disposed 180 degrees out of phase with one another and a second pattern having a pair of sine-wave-like pattern that are disposed 180 degrees out of phase with one another, adjacent one of said first and second patterns being 180 degrees out of phase with one another, said 180 degrees out of phase sine-wave-like patterns of said first and second patterns providing structural integrity and support to the inflatable air mattress.

* * * * *